United States Patent [19]

Shirai

[11] Patent Number: 4,680,561

[45] Date of Patent: Jul. 14, 1987

[54] MICROWAVE WAVEGUIDE FILTER HAVING A METAL PLATE WHICH INCLUDES A RESONANT APERTURE THEREIN

[75] Inventor: Tadao Shirai, Tokyo, Japan

[73] Assignee: Nec Corporation, Japan

[21] Appl. No.: 738,952

[22] Filed: May 29, 1985

[30] Foreign Application Priority Data

May 30, 1984 [JP] Japan ..... 59-110160

[51] Int. Cl.[4] ..... H01P 1/212

[52] U.S. Cl. ..... 333/208; 333/251; 333/211

[58] Field of Search ..... 333/212, 211, 208, 230, 333/227, 251

[56] References Cited

U.S. PATENT DOCUMENTS

| | | | |
|---|---|---|---|
| 2,577,118 | 12/1951 | Fiske | 333/212 X |
| 3,088,082 | 4/1963 | Petrilla et al. | 333/211 |
| 4,028,650 | 6/1977 | Konishi et al. | 333/210 |
| 4,201,956 | 5/1980 | Kienberger et al. | 333/212 X |

FOREIGN PATENT DOCUMENTS

| | | | |
|---|---|---|---|
| 0799163 | 8/1958 | Canada | 333/212 |
| 0045242 | 2/1982 | European Pat. Off. | 333/208 |
| 0152703 | 9/1982 | Japan | 333/211 |

*Primary Examiner*—Eugene R. Laroche
*Assistant Examiner*—Benny T. Lee
*Attorney, Agent, or Firm*—Laff, Whitesel, Conte & Saret

[57] ABSTRACT

A thin plate member of electrically conductive material is disposed within a rectangular waveguide. The plate member has the thickness less than one tenth of the wavelength of a frequency to be suppressed, an opening whose maximum dimension is less than the length of the short side of the waveguide, and a gap formed between two opposite projections extending from the edge of the opening. The plate member is arranged, in said rectangular waveguide, parallel with the electric field and perpendicular to the magnetic field.

3 Claims, 5 Drawing Figures

MICROWAVE WAVEGUIDE FILTER HAVING A METAL PLATE WHICH INCLUDES A RESONANT APERTURE THEREIN

BACKGROUND OF THE INVENTION

1. Field of The Invention

The present invention relates to a band-stop type microwave filter for use in a waveguide.

2. Description of the Prior Art

An active microwave circuit such as an oscillator or amplifier tends to emit second and third harmonics in addition to the fundamental one. These harmonics may disturb other communications in addition to the fundamental itself and hence should be suppressed. To this end, a filter is provided at the input and output terminals of microwave active circuitry.

One known microwave filter is the distributed element type wherein the series inductance thereof is defined by its microwave propagation length and the capacitance determined by a metal piece disposed in the microwave path to shorten the electric field distribution distance.

However, as this conventional filter must be at least as long as one wavelength of the fundamental harmonic it suffers from the drawback of being overly long. By way of example, a filter of this type for use in the 10 GHz band is from 4 to 10 cm in length. Further, as the metal piece must be very carefully machined and installed, the device tends to be very difficult to adjust and expensive to manufacture.

Therefore, a microwave filter which is highly compact and light in weight, has long been awaited especially in the field of radar or satellite communication wherein such requirements are of extreme importance.

SUMMARY OF THE INVENTION

It is therefore an object of the present invention to provide a microwave filter which is simple, small in size and light in weight.

Another object of the present invention is to provide a microwave filter which takes the form of an electrically conductive thin plate member which functions as a lumped element resonator formed of series inductance and capacitance.

Still another object of the present invention is to provide a microwave filter of a thin plate member which is configured to suppress second harmonic of the fundamental frequency.

These objects are fulfilled by a thin plate member of electrically conductive material which is disposed within a rectangular waveguide. The plate member has the thickness less than one tenth of the wavelength of a frequency to be suppressed, an opening whose maximum dimension is less than the length of the short side of the waveguide, and a gap formed between two opposite projections extending from the edge of the opening. The plate member is arranged, in said rectangular waveguide, parallel with the electric field and perpendicular to the magnetic field.

BRIEF DESCRIPTION OF THE DRAWINGS

The features and advantages of the present invention will become more clearly appreciated from the following description taken in conjunction with the accompanying drawings in which like elements and portions are denoted by like reference numerals and in which:

FIG. 2(*b*) is a transversal section of a rectangular waveguide having therein a microwave filter according to the present invention;

FIG. 2(*c*) is a transversal section of a rectangular waveguide having a filter with a rectangular opening.

DETAILED DESCRIPTION OF THE PREFERRED EMBODIMENTS

Figure 1:
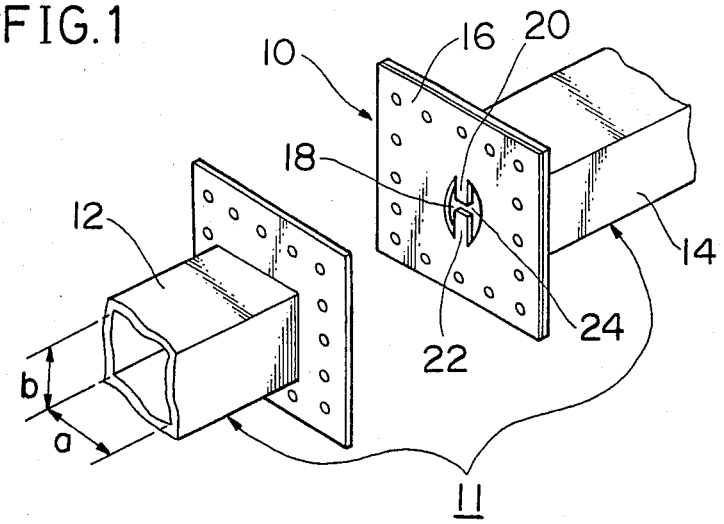
FIG. 1 is a perspective view of a microwave filter according to the present invention, which filter is installed in a two piece rectangular waveguide.

Reference is now made to FIG. 1, wherein a microwave filter 10 according to the present invention is shown in perspective. The filter 10 is arranged within a rectangular waveguide 11 which in this embodiment consists of first and second interconnectable wave guide sections 12 and 14. The rectangular waveguide 11 has a long side of inner length "a" and a short side of inner length "b". As shown, the filter 10 has a peripheral portion which is arranged to be sandwiched between the flanges of the waveguides 12 and 14. It will be noted that in this figure wave guide section 12 is shown detached in a manner which enables the entire filter 10 to be seen.

The filter 10 is a plate member 16 of electrically conductive material such as metal, and has a thickness less than one tenth of the wavelength of a frequency to be suppressed. Further, the plate 16 has an opening 18 whose diameter (viz., maximum dimension) is less than the inner short length "b", and has two opposed projections 20 and 22 which extend from the edge of the opening 18 and define a gap 24 therebetween.

Figure 2A:
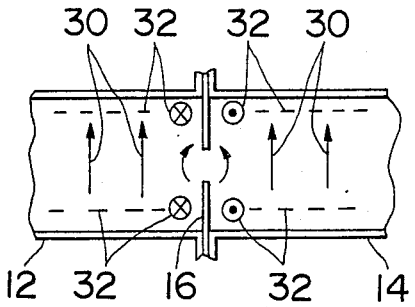
FIG. 2(*a*) is a longitudinal section of a rectangular waveguide having therein a microwave filter according to the present invention.
Figure 2B:
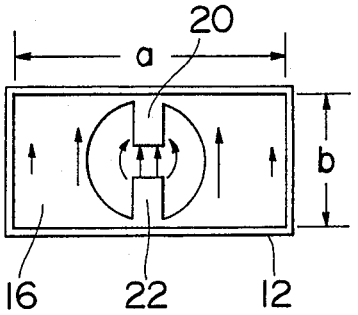
Figure 2C:
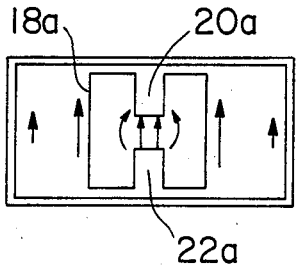

FIGS. 2(*a*) and 2(*b*) are respectively longitudinal and transversal sections of the rectangular waveguide having therein the microwave filter 10 shown in FIG. 1. As shown in FIGS. 2(*a*) and 2(*b*), the plate member 16 is arranged in the rectangular waveguide in a manner as to be parallel with the electric flux 30 (solid lines) and normal to the magnetic flux 32 (denoted by phantom, and circled · and x). It will be noted that as the waveguide is rectangular the dominate wave form is $TE_{10}$, wherein its electric lines are parallel to the shorter side of the guide.

As mentioned above, the plate 10 is made of a thin electrically conductive material whose thickness is less than one tenth of the frequency to be suppressed. This is because if the plate 10 is thick, another electric field mode may be generated. Thus limiting the thickness of the plate 10, allows the inductance as well as capacitance to be defined only by the dimensions of the opening 18 and gap 24.

As shown in FIGS. 2(*a*) and 2(*b*), the filter 10 acts as an obstacle to the $TE_{10}$ mode propagation path. When the plate 10 interrupts the electric field, the inductance of the microwave path increases, while, when the plate 10 interrupts the magnetic field, the capacitance of the path increases. By adjusting the dimensions of the opening and the gap, the filter functions as a series inductance and capacitance lumped resonator. In the foregoing, the opening 18 is circular but not limited to same. The opening 18*a* may be rectangular (as shown in FIG.

2(*c*) wherein the maximum opening dimension should be less than the inner short length "b". In FIG. 2(*c*), the reference numerals of parts corresponding to the parts in FIG. 1 are the same, except that the suffix "a" has been added in FIG. 2(*c*). Thus, the rectangular opening 18*a* is partially divided by two opposing projections 20*a*, 22*a*, to define a gap therebetween.

Figure 3:
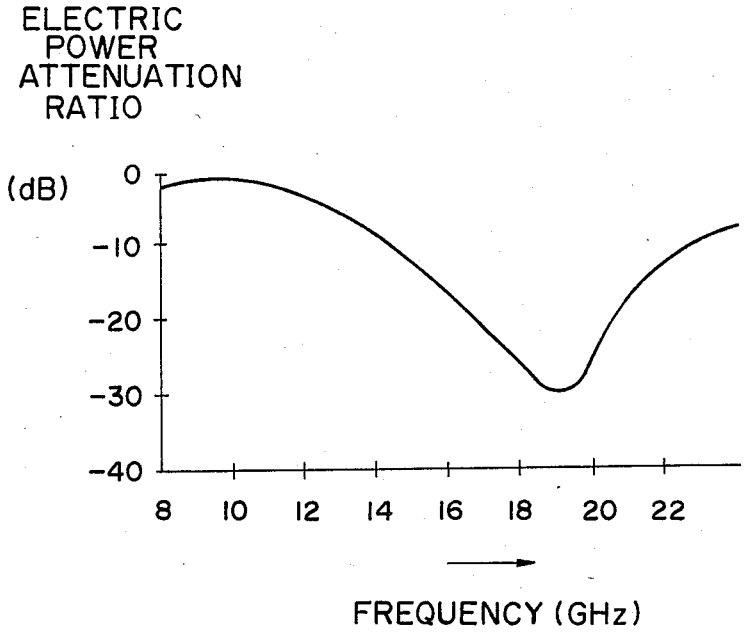
FIG. 3 is a graph showing in terms of frequency and electric power attenuation ratio, the band stop characteristics obtained with the present invention.

According to the inventor's experiment of employing the microwave filter of this invention wherein the fundamental frequency is 9.4 GHz, suppression ratio of second harmonic (18.8 GHz) can be obtained as shown in FIG. 3, wherein a=22.9 mm; b=10.2 mm; the diameter of opening 18 = 9 mm; gap 24=0.6 mm; and the width of gap 24 =2 mm.

It will be noted that due to the very simple nature of the filter according to the present invention it is possible to produce same using a simple press or chemical etching technique. This of course reduces the cost of manufacturing the device remarkably.

An advantage of the embodiment of FIG. 2(*b*) with a circular opening is that there are no sharp corners or abrupt changes in geometry to cause undesired noise.

The foregoing description shows only preferred embodiments of the present invention. Various modifications are apparent to those skilled in the art without departing from the scope of the present invention which is only limited by the appended claims.

What is claimed is:

1. A microwave filter for use in a rectangular waveguide, said filter comprising:

a plate member made of electrically conductive material, said plate having a thickness which is less than one-tenth of the wavelength of a frequency which is to be suppressed, said plate containing an opening which is circular and which has a maximum dimension that is less than the length of the short side of said rectangular waveguide, and two opposed projections which form part of said plate and which extend inwardly from diametrically opposed positions on the circumference of said circular opening, inner ends of said opposing projections defining a gap therebetween, said gap being near the center of the opening, said plate member being arranged in said rectangular waveguide to be parallel with the electric field in the waveguide and normal to the magnetic field in the waveguide.

2. A microwave filter for use in a rectangular waveguide, said filter comprising:

a plate member of electrically conductive material, said plate having a thickness less than one-tenth of the wavelength of a frequency to be suppressed, said plate defining a circular opening having a diameter which is less than the length of the short side of said rectangular waveguide, and said plate further having two opposed projections which extend inwardly, from diametrically opposing positions on the circumference of said circular opening, toward the center of said opening, the ends of said projections defining a gap therebetween at the center of the circle, said plate member being arranged in said rectangular waveguide, parallel with the electric field in the waveguide and normal to the magnetic field in the waveguide.

3. A microwave filter as claimed in claim 2, wherein said opening and gap have dimensions such that said plate member functions as a resonator for a frequency which is to be suppressed.

* * * * *